United States Patent [19]

Nakanishi

[11] Patent Number: 4,544,283

[45] Date of Patent: Oct. 1, 1985

[54] ALARM TIMEPIECE WITH FACILITIES OF PROVIDING PRECAUSIONARY ALARM

[75] Inventor: Yasuhiro Nakanishi, Nara, Japan

[73] Assignee: Sharp Kabushiki Kaisha, Osaka, Japan

[21] Appl. No.: 171,804

[22] Filed: Jul. 24, 1980

[30] Foreign Application Priority Data

Jul. 25, 1979 [JP] Japan ..... 54-95194

[51] Int. Cl.[4] ..... G04C 21/16

[52] U.S. Cl. ..... 368/251

[58] Field of Search ..... 368/72–74, 368/250–251, 28, 29, 41

[56] References Cited

U.S. PATENT DOCUMENTS 3,999,050 12/1976 Pitroda ..... 368/10
4,162,610 7/1979 Levine ..... 368/41
4,234,944 11/1980 Komaki et al. ..... 368/72
4,255,803 3/1981 Sekine ..... 368/251
4,276,541 6/1981 Inoue et al. ..... 368/251

*Primary Examiner*—Vit W. Miska
*Attorney, Agent, or Firm*—Birch, Stewart, Kolasch & Birch

[57] ABSTRACT

An alarm timepiece is capable of providing an alarm sound twice, one time well before the announcement time and the other at sharply the alarm announcement time. The alarm time-piece includes a first register for storing preset points in time in which to actuate the main alarm; a second register for storing a given length of preparatory time a decision circuit for determining when provide a precautionary alarm as well as the subject alarm time through calculation on said preset points in time, updated time of day and the preparatory period. The calculation is executed through the use of an adder/subtractor and comparator.

5 Claims, 2 Drawing Figures

Clock Generator
CG
Divider
DV
Counter
CO
Advance Announcement Time Register
X
A1
Adder/ Subtractor
Y1
Detectors
J1
Gate
G1
Schedule Register
AL 11
AL 12
Schedule Message Register
A2
Y2
J2
G2
AL 21
AL 22
An
Yn
Jn
Gn
ALn1
ALn2
Gate Circuit
H
Display
DSB
DR
DSP
Schedule Display Buffer
Driver
K
Keyboard
CPU
Y1 J1 Y2 J2 Yn Jn
1
2
F
ALM
SP
Alarm Sound Generator

ALARM TIMEPIECE WITH FACILITIES OF PROVIDING PRECAUSIONARY ALARM

BACKGROUND OF THE INVENTION

The present invention relates to an alarm timepiece.

For alarm watches or other timepieces it is essential to provide an alarm when a preset time is reached. Nonetheless, the conventional alarm timepiece has the disadvantage in that the operator has to caculate back the length of time necessary for him to prepare or finish his work before he leaves the office at exactly the preset alarm time. He then sets the alarm time while taking such preparatory period of time into consideration.

OBJECTS AND SUMMARY OF THE INVENTION

Accordingly, it is an object of the present invention to provide an improved alarm timepiece which provides not only main alarms but also precausionary alarms a length of preparation time in advance of the main alarms.

To achieve this object, the present invention provides a timepiece comprising a first register storing preset points in time for the main alarm; a second register for storing a given length of preparatory time; and means for determining when to provide a precautionary alarm as well as the main alarm time through calculation on said preset points in time or an updated time of day and said preparatory period. Preferably, the length of the preparatory period is optionally selectable by the user because it varies according to intention; for example, announcement of when to start conferences, when to leave the office, when to telephone someone, when to get up.

The present invention is further applicable to an electronic diary which has registers for storing unique schedule messages associated with respective points in time to alarm. In this case, the present invention offers advantages: a reduced number of registers and simple key operation. In other words, in the prior art electronic diary as disclosed in U.S. Pat. No. 3,999,050 to Satyan G. Pitroda, there is the need to learn messages regarding scheduled events and set the time and dates of these events when the messages are to be served by an alarm. However, neither the setting of the alarm date and time nor the provision of an alarm register is necessary in the practice of the present invention by which precausionary alarms are delivered, for example, 10 minutes ahead of the time and dates of the scheduled events.

BRIEF DESCRIPTION OF THE DRAWINGS

The foregoing as well as other objects, features and advantages of the present invention will become more readily appreciated upon the consideration of the following detailed description of the illustrated embodiments, together with the accompanying drawings, wherein.

DETAILED DESCRIPTION OF THE INVENTION

Figure 1:
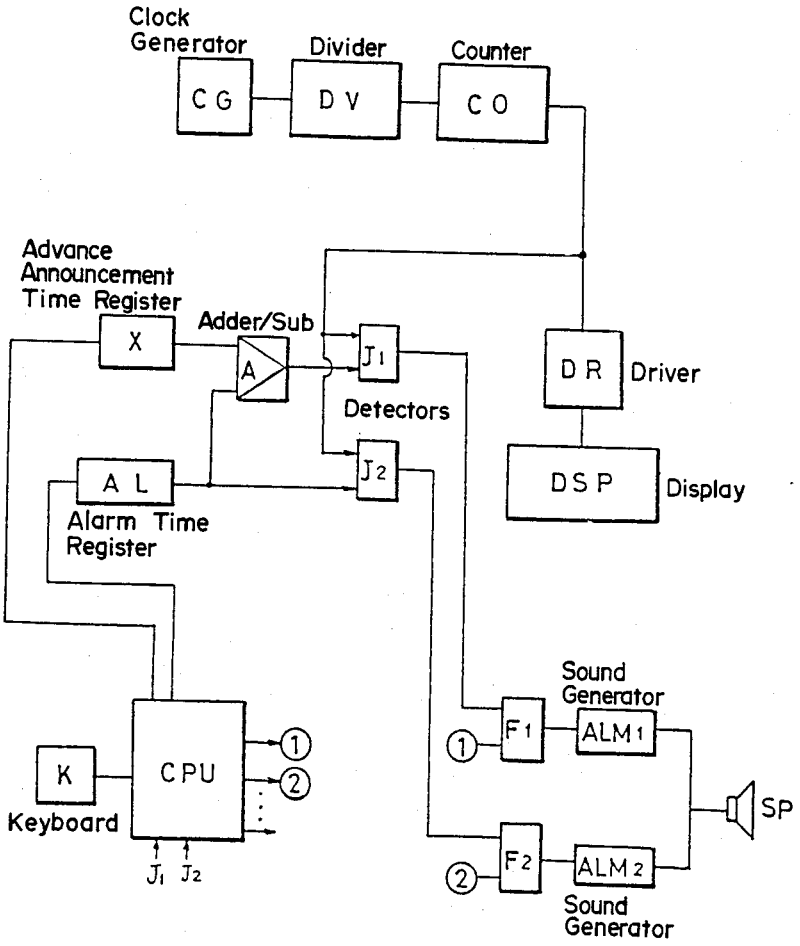
FIG. 1 is a schematic block diagram of one preferred form of the present invention.

Referring now to FIG. 1, one embodiment of the present invention is provided with a clock generator CG, a divider $DV_1$, a timekeeping counter CO, a register X storing points in time to deliver precausionary announcements, an adder/subtractor A, an alarm time register AL, a pair of agreement detectors $J_1$ and $J_2$, a display driver DR, a display panel DSP, an input keyboard K, a sequential control circuit CPU, flip flops $F_1$ and $F_2$, a pair of alarm sound generators $ALM_1$ and $ALM_2$, and a loud speaker SP. In this drawing, gate control signals are labeled ① and ②.

Clock signals from the clock generator CG are divided through the divider DV, while real time of day is updated with the timekeeping counter CO of which the count is visually displayed on the display panel DSP via the driver DR.

Upon actuation of the input keyboard K desired points in time in which generate an alarm are loaded into the alarm time register AL via the sequential control circuit CPU. The detector $J_2$ decides whether the alarm time and updated time agree and, if so, provides its putput "1" which in turn sets the flip flop $F_2$ to enable the alarm sound generator $ALM_2$ and the loud speaker SP to thereby release an alarm sound. The sequence up to this operation is identical to the time-honored manner.

The storage register X stores preselected values indicative of elapsed times for precautionary announcements as introduced via the input keyboard K. The adder/subtractor A subtracts the contents of the precautionary announcement time register X (say, 5 minutes) from the contents of the alarm time register AL (say 11:00 a.m.). In the given example, 10:55 a.m. is evaluated from the adder/subtractor A and introduced into the agreement detector $J_1$. As stated above, the first detector $J_1$ decides whether the update time of day presented as the output of the timekeeping counter CO corresponds to the output of the adder/subtractor A and, if affirmative, provides its output "1", placing the flip flop $F_1$ into the set state. The result is that the loud speaker SP is enabled via the alarm sound generator $ALM_1$ to release an alarm sound. It is favorable that the alarm sounds from the alarm sound generators $ALM_1$ and $ALM_2$ be different in tone, loudness or melody to distinguish this precausionary alarm from the subject or later alarm. After the alarm sounds are delivered, the sequential control circuit CPU produces the gate control signal ① or ② to reset the flip flop $F_1$ or $F_2$ upon actuation of a stop key in the keyboard K, thereby discontinuing the generation of the alarm sounds.

By way of example, if 11:00 is preset as alarm time and a duration of 5 minutes is selected as the preparatory time, then the precautionary alarm is delivered at 10:55 a.m. and the subject alarm at sharply 11:00 a.m.

Figure 2:
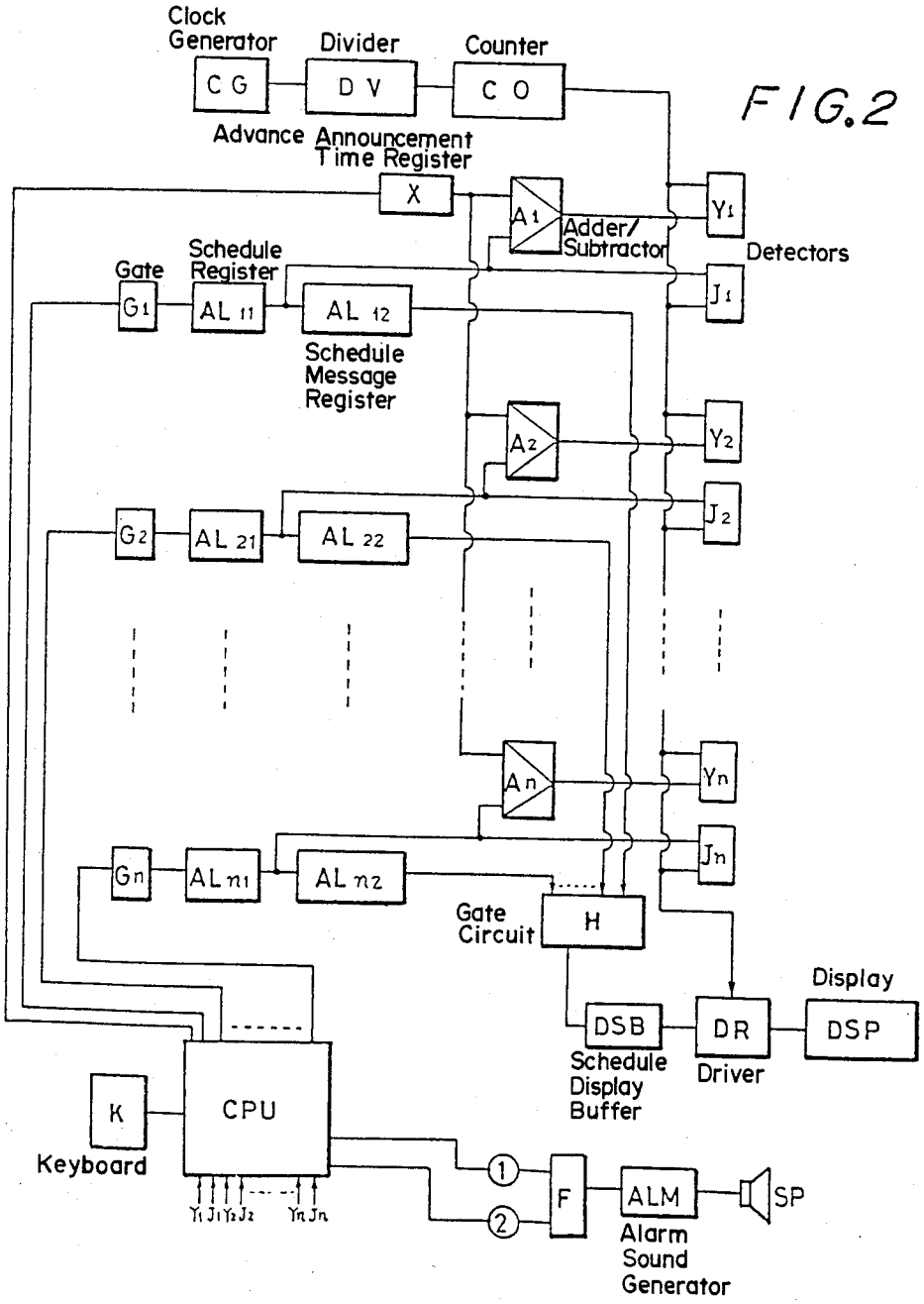
FIG. 2 is a schematic block diagram of another preferred form of the present invention.

FIG. 2 shows another preferred embodiment of the present invention which includes a clock generator CG, a divider DV, a time-and-date timekeeping counter CO, an advance announcement time register X, adder/subtractors $A_1$, $A_2$ . . . $A_n$, gate circuits $G_1$, $G_2$, . . . $G_n$, schedule registers $AL_{11}$, $AL_{21}$, . . . $AL_{n1}$, schedule message registers $AL_{12}$, $AL_{22}$, . . . $AL_{n2}$, agreement detectors $Y_1$, $Y_2$ . . . $Y_n$, agreement detectors $J_1$, $J_2$ . . . $J_n$, a gate circuit H, a schedule display buffer register DSB, a display driver DR, a display panel DSP (typically, the dot matrix type), an input keyboard K, a sequential control circuit CPU, a flip flop F, an alarm sound generator ALM and a loud speaker SP. In this drawing, gate control signals are labeled ① and ②.

Clock signals from the clock generator CG are divided through the divider DV and the timekeeping circuit CO updates the current time and date. The contents of the timekeeping counter CO are visually displayed on the display panel DSP via the driver DR. Scheduled events are stored into the schedule registers by applying input signals thereto via the sequential control circuit CPU. The respective ones of the schedule registers mate as a pair with the respective ones of the schedule message registers, for example, $AL_{11}$, and $AL_{12}$, $AL_{21}$ and $AL_{22}$ . . . $AL_{n1}$ and $AL_{n2}$. Where a full message "Aug. 22, 1979, 2:30 p.m., sales conference", for example, is introduced through the input keyboard K, the schedule time and date register $AL_{11}$ contains "Aug. 22, 1979, 2:30 p.m." and the schedule event register $AL_{12}$ stores "sales conference". The agreement detector $J_1$ constantly monitors whether the contents of the schedule time and date register $AL_1$ are in agreement with those of the timekeeping counter CO. The adder/subtractor $A_1$ calculates the contents of the schedule time and date register X minus those of the precausionary announcement time register X. The agreement detector $Y_1$ always senses if the output of the adder/subtractor $A_1$ as the precausionary alarm time and the contents of the timekeeping counter CO coincide. For example, where the value in the register X is 10 minutes, the adder/subtractor A provides an indication of "Aug. 22, 1979, 2:20 p.m." which is 10 minutes less than the contents of $AL_{11}$.

Once the either the agreement detector $Y_1$ or $J_1$ has provided its affirmative answer, the gate control signal ① assumes a higher level "1" and sets the flip flop F, enabling the loud speaker SP via the alarm sound generator ALM to release the precausionary alarm which is an important part of the present invention. At the same time the contents of the two schedule registers $AL_{11}$ and $AL_{12}$ are unloaded into the schedule display buffer register DSB via the gate H to provide a visual display of "Aug. 22, 1979, 2:30 p.m., sales conference" on the display panel DSP via the driver DR. This visual display is provided twice: during the delivery of the subject alarm and during that of the precausionary alarm. The stop key when actuated ceases the delivery of the alarm sounds from the loud speaker SP by developing the gate control signal ② useful to reset the flip flop F. Simultaneously, the timekeeping counter CO is unloaded into the display driver DR to resume the update time display mode.

The other schedule registers $AL_{21}$, $AL_{22}$ . . . $AL_{n1}$, $AL_{n2}$ operate in the same manner as discussed with the registers $AL_{11}$ and $AL_{12}$. Different schedules and events are sequentially announced in the order of time. As noted earlier, the preparatory period may be optionally varied according to intention.

It is obvious to those skilled in the art that one way to calculate the precausionary alarm time is either to subtract the preparation period from the alarm time storing section or to add the preparation period to the updated time and sense if the both agree.

The invention being thus described, it will be obvious that the same may be varies in many ways. Such variations are not to be regarded as a departure from the spirit and scope of the invention, and all such modifications are intended to be included within the scope of the following claims.

What is claimed is:

1. An electronic appointment calendar comprising:

time and date timekeeping means for producing a timekeeping signal representative of actual time;

schedule time and message register means for storing a schedule time and its associated alphanumeric message, said schedule time and message register means producing a schedule time signal;

detector means for comparing said schedule time signal with said timekeeping signal and producing a first coincidence signal upon the coincidence thereof;

advance time announcement register means for storing an advance notice elapsed time period and for producing an elapsed time period signal;

calculator means for calculating an advance advising time from said elapsed time period signal and said schedule time signal and producing a signal representative thereof;

said detector means further comparing said advance advising time signal with said timekeeping signal and producing a second coincidence signal upon the coincidence thereof;

means for displaying said schedule time and its associated message in response to the generation of at least one of said first and second coincidence signals by said detector means; and alarm means for generating a first alarm in response to generation of said first coincidence signal and a second alarm in response to generation of said second coincidence signal.

2. The calender of claim 1 wherein said calculator means is an adder/subtractor.

3. The calendar of claim 1 wherein said first alarm is audibly different from said second alarm.

4. The calendar of claim 3 wherein the audible difference between said first and second alarms is in tone, volume or melody.

5. The calendar of claim 4 further comprising alphanumeric keyboard means for entering said schecule time and its associated alphanumeric message and said advance notice elapsed time period.

* * * * *